US006685581B2

(12) United States Patent
Krause et al.

(10) Patent No.: US 6,685,581 B2
(45) Date of Patent: Feb. 3, 2004

(54) ATHLETE TRAINING DEVICE

(75) Inventors: Harry W. Krause, Rock Hill, SC (US); Jeffrey Lowery, Charlotte, NC (US)

(73) Assignee: Rae Crowther Company, Rock Hill, SC (US)

( * ) Notice: Subject to any disclaimer, the term of this patent is extended or adjusted under 35 U.S.C. 154(b) by 60 days.

(21) Appl. No.: 09/826,344

(22) Filed: Apr. 4, 2001

(65) Prior Publication Data

US 2002/0147061 A1 Oct. 10, 2002

(51) Int. Cl.[7] ..... A63B 69/34
(52) U.S. Cl. ..... 473/445; 473/441
(58) Field of Search ..... 473/422, 438–445, 473/FOR 124, FOR 125; 273/317.1, 317.5

(56) References Cited

U.S. PATENT DOCUMENTS

| | | | | | |
|---|---|---|---|---|---|
| 2,620,188 | A | * | 12/1952 | Malagio | 473/442 |
| 2,653,816 | A | * | 9/1953 | Young et al. | 473/445 |
| 2,967,709 | A | * | 1/1961 | Stahley | 473/441 |
| 3,062,547 | A | | 11/1962 | Kopp | |
| 3,216,724 | A | * | 11/1965 | Williams | 473/445 |
| 3,236,101 | A | * | 2/1966 | Lemonick | 473/441 |
| 3,326,553 | A | | 6/1967 | Forrest | |
| 3,365,947 | A | * | 1/1968 | Janich, III et al. | 473/441 |
| 3,514,105 | A | * | 5/1970 | Pilliard | 473/441 |
| 3,649,016 | A | * | 3/1972 | Kelley, Jr. | 473/441 |
| 4,017,075 | A | | 4/1977 | Wilson | |
| 4,067,571 | A | | 1/1978 | Rogers | |
| 4,087,089 | A | | 5/1978 | Forrest | |
| 4,175,744 | A | * | 11/1979 | Llewellyn | 473/149 |
| 4,186,922 | A | | 2/1980 | Ketchum | |
| 4,508,341 | A | | 4/1985 | Carrington | |
| 4,736,947 | A | | 4/1988 | Jenkins | |
| 4,802,670 | A | | 2/1989 | Smith | |
| 5,013,039 | A | * | 5/1991 | Cole | 473/445 |
| 5,385,523 | A | | 1/1995 | Forrest | |
| 5,462,272 | A | | 10/1995 | Staten | |
| 5,888,152 | A | | 3/1999 | Rogers et al. | |
| 5,924,930 | A | * | 7/1999 | Stewart | 473/29 |

* cited by examiner

*Primary Examiner*—Paul T. Sewell
*Assistant Examiner*—Mitra Aryanpour
(74) *Attorney, Agent, or Firm*—Charles L. Schwab; Nexsen Pruet Jacobs & Pollard, LLC

(57) ABSTRACT

An athletic practice machine for training offensive and defensive players, such as football players and for training martial arts and kick boxing athletes. Each dummy of the training device may be latched in a spring loaded retracted position and the dummies may be individually released to spring to a forward leaning position simulating opponent movement. The dummy release may be accomplished by movement of a coach's staff. In training units having three laterally spaced dummies, the end dummies are positioned forward of the central dummy and face inwardly to form an arc. Movement of the helmet bearing staff forward releases the central dummy and lateral movement of the helmet bearing staff releases the dummy on the side toward which the staff is moved.

30 Claims, 8 Drawing Sheets

52
5
51
55
55
18
26
31
61
68
73
67
66
58
56
57
29
30
5
14

ATHLETE TRAINING DEVICE

TECHNICAL FIELD

This invention relates to equipment employed to improve skills of athletes and practically to a training device with dummies.

BACKGROUND OF THE INVENTION

Various training apparatus in the form of blocking sleds and the like have been used and suggested for developing the physical and mental reactions of football linemen. For instance, U.S. Pat. No. 3,062,547 issued Nov. 6, 1962 to H. W. Kopp for a Defensive Reaction Football Training Sled discloses a sled with a padded bumper mounted on a pair of laterally spaced posts. The bumper has spring loaded and hinged corner sections which will individually swing forward when released from a retracted, latched position by lateral movement of a centrally positioned helmet. The helmet may be pivoted rearwardly to simulate movement of an opposing lineman.

In U.S. Pat. No. 4,802,670 issued Feb. 7, 1989 to D. R. Smith for a Football Blocking Apparatus a blocking pad is mounted on an end of a ram which slides horizontally in a support carried by two posts which are vertically adjustable U.S. Pat. No. 5,462,272 issued Oct. 31, 1995 to K. E. Staten for a Football Training Sled discloses a blocking pad on a telescoping arm. The spring loaded telescoping arm is pivoted on a support post for vertical swinging but is held in a forward projecting position by a latch. When the pad is moved rearwardly a predetermined distance the latch is released and the pad is free to swing upwardly.

DISCLOSURE OF THE INVENTION

The training equipment of this invention includes placement of resiliently biased dummy modules in an arc to simulate positioning of athletes engaged in physical competition such as football, martial arts and kick boxing. This training equipment may provide selective movement of individual dummies to simulate movement of opposing contestants. The effectiveness of the training exercise is improved without requiring a trainer or trainee to hold a shield and be subjected to repeated hits and punches. The trainees who were previously needed to hold shields or dummies are available for their own training, thus accelerating the rate of individual and team learning. The athletes can practice at half speed or full speed with the training equipment without beating up on each other.

In one embodiment of the invention, the training athlete must exert a predetermined effort to move the spring loaded dummy module from its extended position to a retracted position. The mounting of the dummy module with its forward inclination, makes it difficult to move the dummy to its retracted, latched position from a stance higher than the dummy. The trainee can not fake the practice effort. The movement of a helmet staff releases the dummy module corresponding to the direction of helmet movement thereby simulating a football player movement and providing training and testing of player reaction. However, the presence of a coach or trainer is not required for use of the training equipment, thus permitting athletes to practice and improve their skills before or after their scheduled practice periods.

Angling the dummy module toward the ground realistically imitates the body angle of an opposing football player. The player must maintain a proper base stand with leverage to latch the dummy module. The player is taught to avoid overextending, with attendant loss of leverage. This training machine is particularly effective in developing offensive linemen in respect to footwork, body position and punch control needed for good pass protection. Movement of the helmet and dummy simulates defenders movement.

Placement of the outside dummy modules forward of the inside dummy, and facing slightly inward, in a multiple dummy training machine, simulates typical playing conditions. Adjustment of the height of the individual dummies affords realistic player positions of offensive players during passing, kicking and running downs. The height adjustment of the dummy is preferably between a position representing a down lineman stance of about three feet in height and a standing player stance of about six feet in height. The dummies may be spaced in a shoulder-to-shoulder position or they may be spaced to leave a desired opening between dummies. By use of equipment incorporating this invention, players can be trained to react to a wide variety of situations encountered in an actual football game.

The training machine provides effective training in martial arts and kick boxing. Release of one or more dummies gives the trainee an aggressive opponent on which he can improve his kicks and punches. The training athlete can kick the dummy pads with his foot or punch the dummy pad with his hand or forearm. A hard, forceful blow is required to teach martial arts and kick boxing and this machine helps to teach the proper technique.

The training machine preferably includes ground engaging runners which support a coach's platform and a support beam with posts carrying the columns on which the dummies are mounted. This construction affords mobility and a convenient observation/operation post for the coach. Removable beam extensions with additional dummies are an option enhancing the usefulness of the training machine.

BRIEF DESCRIPTION OF THE DRAWINGS

One embodiment of the invention is illustrated in the drawings, in which.

BEST MODE FOR CARRYING OUT THE INVENTION

Figure 1:
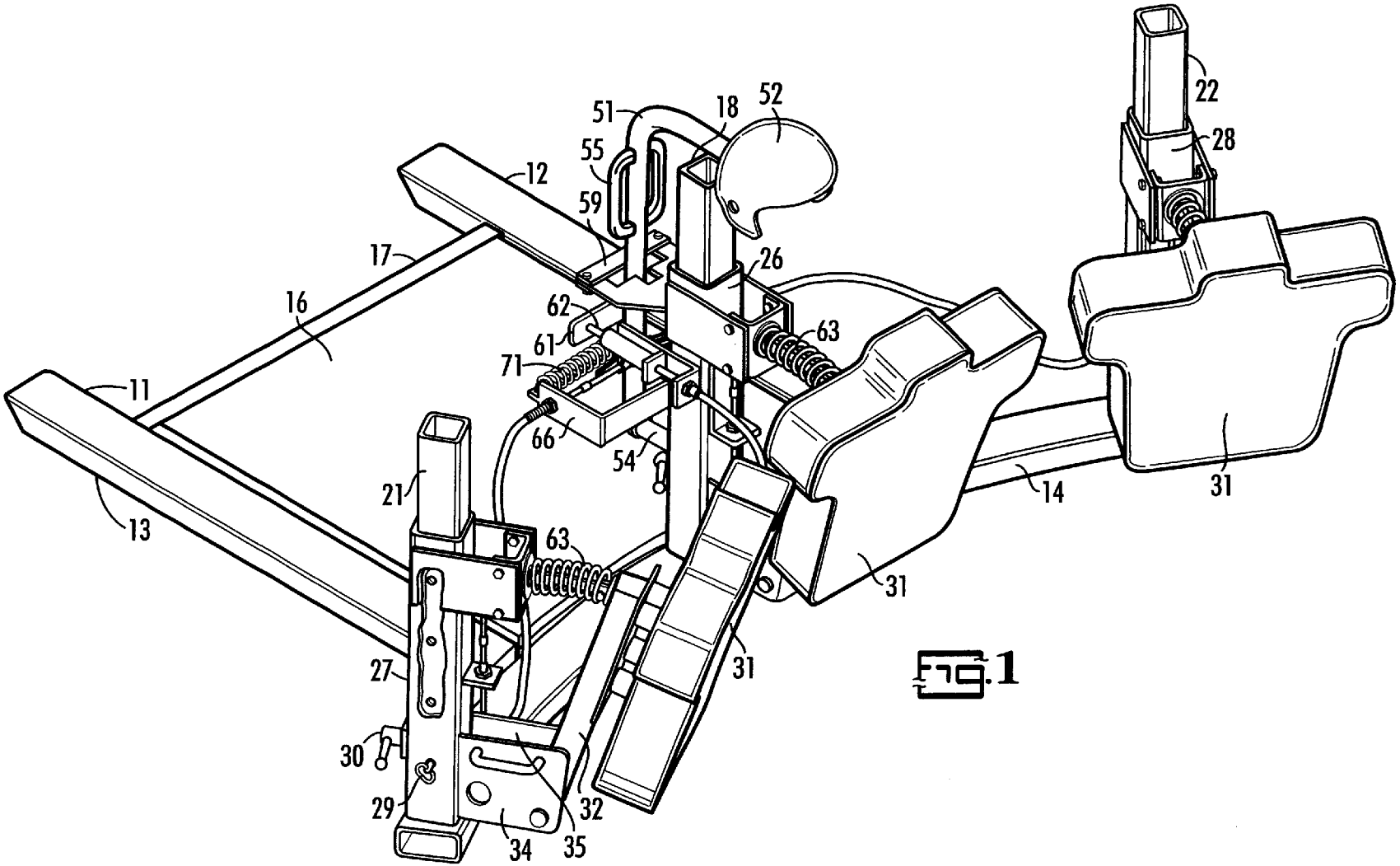
FIG. 1 is a perspective view from the right front of the training device.
Figure 2:
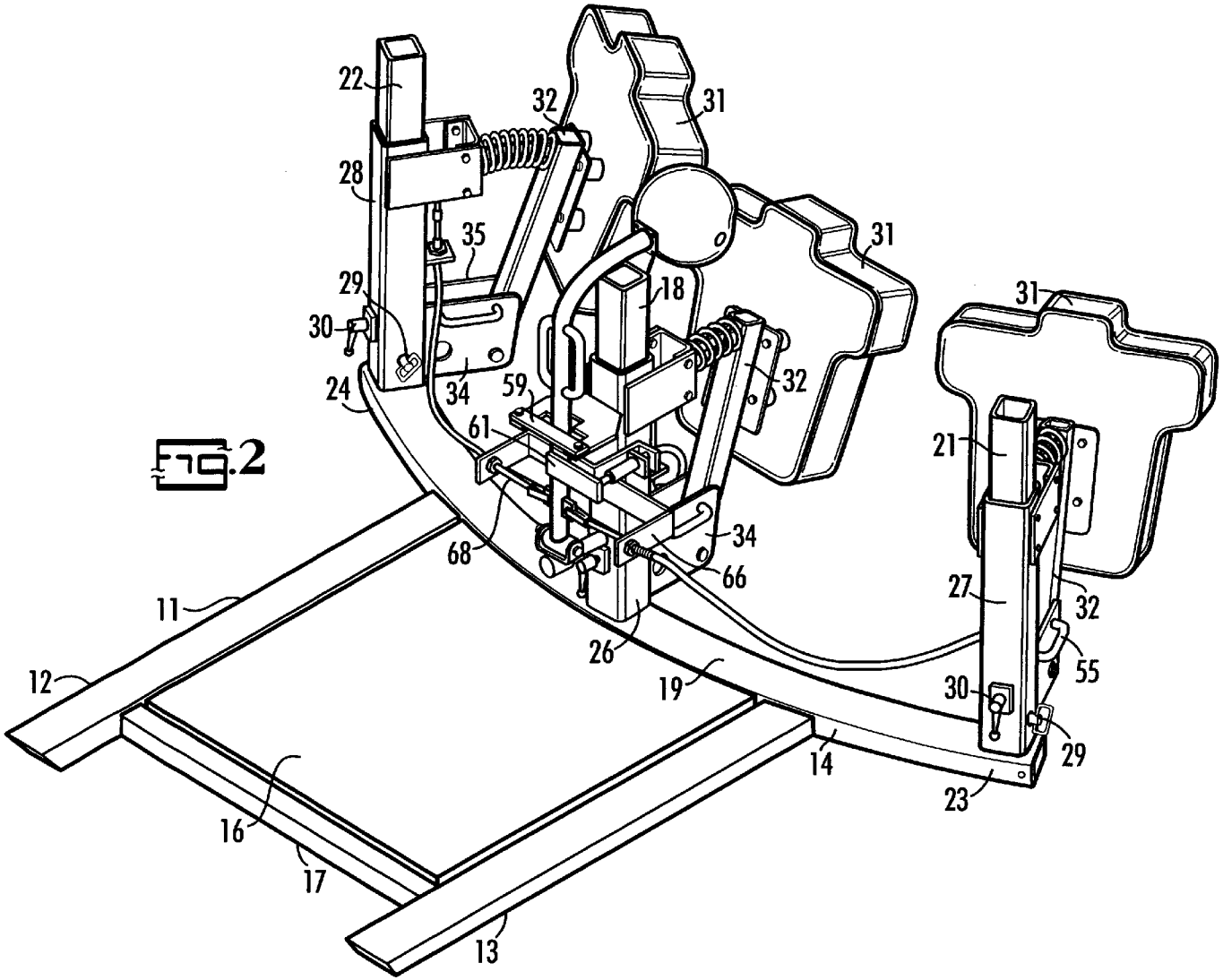
FIG. 2 is a perspective view from the right rear of the training device.
Figure 3:
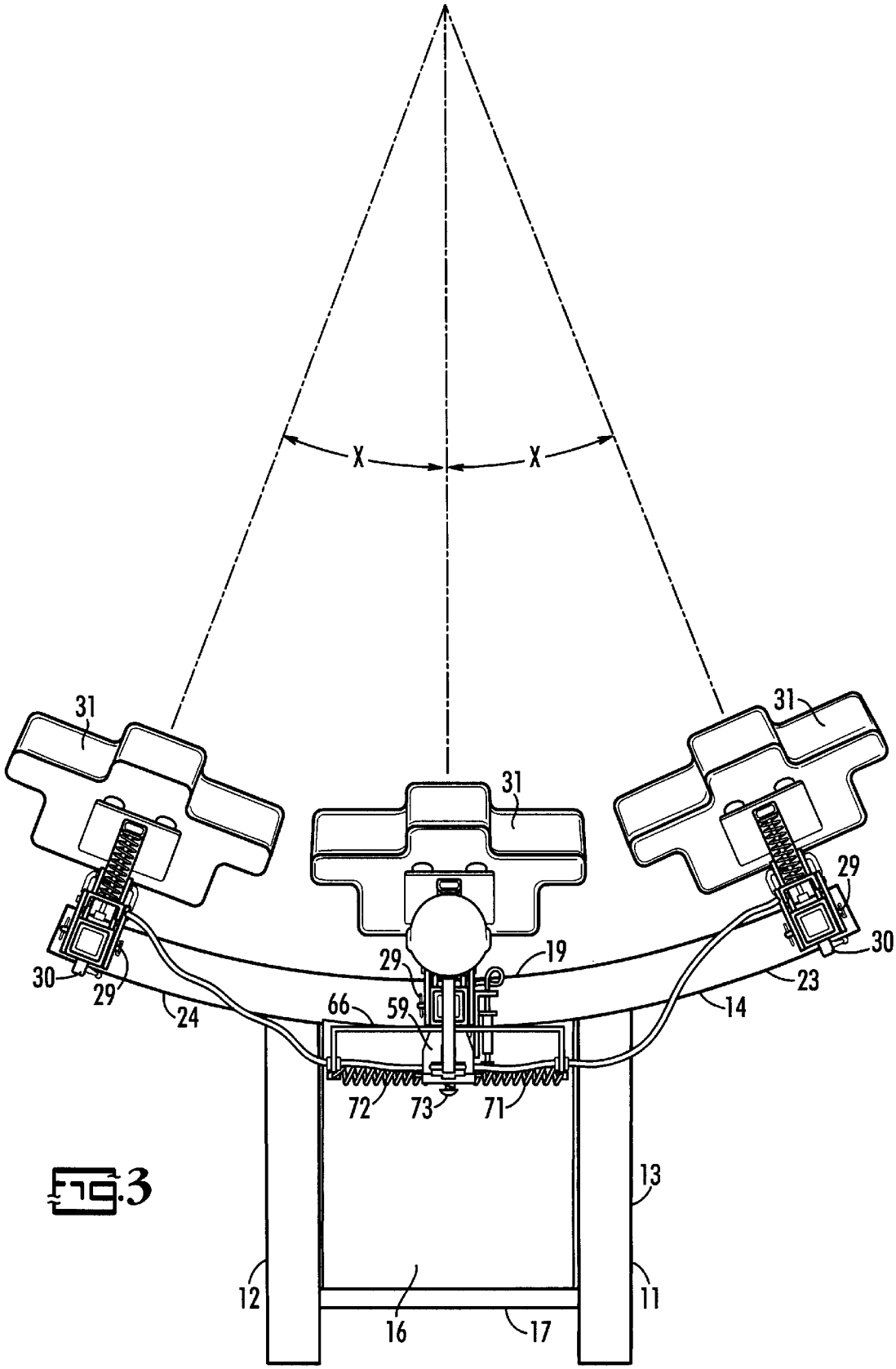
FIG. 3 is a top view of the training device.

As illustrated in FIGS. 1, 2 and 3, the athlete training device includes a ground engaging base or sled 11 having a longitudinally extending part which includes a pair of fore and aft extending parallel runners 12, 13. An arcuate beam 14 is rigidly secured to the front ends of the runners 11, 12.

A floor 16 for supporting instructing personnel is mounted on the runners 11, 12, the arcuate beam 14 and a rear transverse beam 17 rigidly interconnected to the rear segments of the runners. An upright central post 18 is rigidly secured at its lower end, as by welding, to a central part 19 of the arcuate beam 14 and upright lateral positioned posts 21, 22 are rigidly secured to, respectively, end parts 23, 24 of the arcuate beam 14.

As shown in FIG. 3, the end parts 23, 24 extend laterally outward and forward from the central part 19 and the posts 18, 21, 22 are circumferentially spaced at intervals about an arc of a circle defined by the position of the posts 18, 21, 22. Specifically, the angle x of the arcuate spacing of the posts 18, 21, 22 is 25 degrees in the illustrated embodiment of the invention shown in FIGS. 1–3; however the angle may be less than 25 degrees and could be as much as 37½ degrees or more. The posts 18, 21, 22 are preferably tubular with a square cross section. Four-sided tubular column parts or columns 26, 27, 28 are telescopically mounted on the posts 18, 21, 22, respectively. The columns 26, 27, 28 are vertically adjustable relative to the posts 18, 21, 22 and are maintained in one of four elevations by removable pins 29 passing through aligned openings in the columns 26, 27, 28 and the posts 18, 21, 22. In FIG. 1, portions of the column 27 are broken away to show openings in the post 21 which permit four positions of vertical adjustment of the column 27.

A set-screw 30, having a handle permitting manual loosening and tightening is in threaded engagement with each of the columns 26, 27, 28 to hold it against the associated one of the posts 18, 21, 22. The posts 18, 21, 22 and the associated columns 26, 27, 28 serve as supports for dummy modules, each consisting of a dummy 31 and a dummy support part or boom 32. Each dummy 31 is rigidly secured to the boom 32 which has its lower end pivotally connected by a horizontally disposed pin 33 to a pair of mounting brackets 34, 35 rigidly secured to lower part of each of the columns 26, 27, 28.

Referring to FIGS. 5, 6, 10 and 11, the upper end of the boom 32 is connected to the upper end of the column 26 by a latch which includes a longitudinally disposed latch lever 41 pivotally connected at its forward end to the boom 32 by a pin 42. The latch lever 41 extends rearwardly through an opening 44 in a vertical wall 43 secured by bolts and nuts to parallel vertical plates 45, 46 welded to and extending forward from the column 26. The rear end of the lever 41 is biased downwardly by a pair of tension springs 36, 37 connected at their upper ends to the rear end of the lever 41 and connected at their lower ends to a rod 38 secured to a pair of flanges 39, 40 welded to the column 26. The lever 41 has a notch 48 which presents an abutment surface engagable with a complimentary abutment surface on the rear of the wall 43 below the opening 44. The lever 41 thus serves as an essential part of a motion limiting mechanism for the dummy 31.

Figure 4:
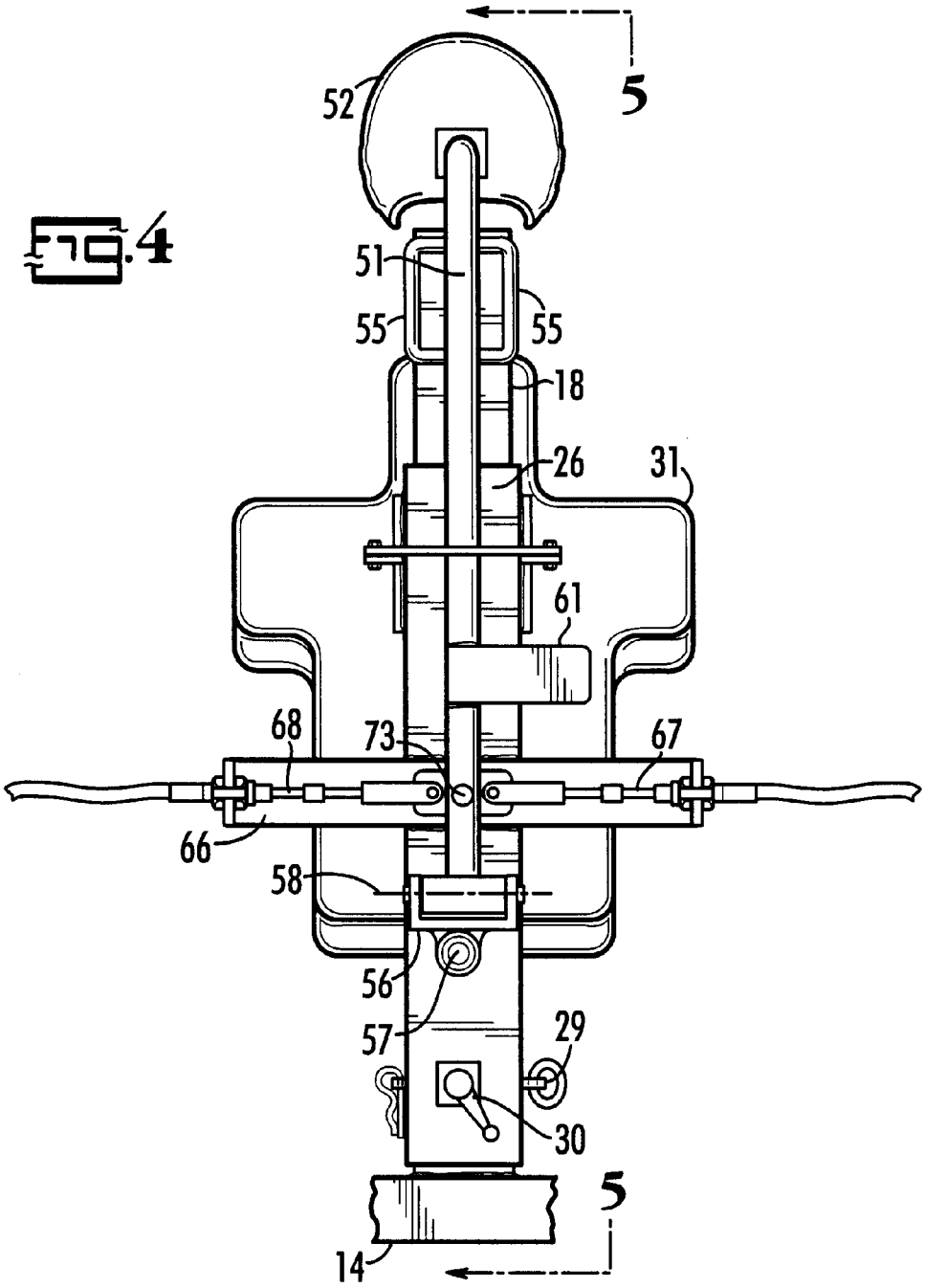
FIG. 4 is rear view of a central dummy module.
Figure 5:
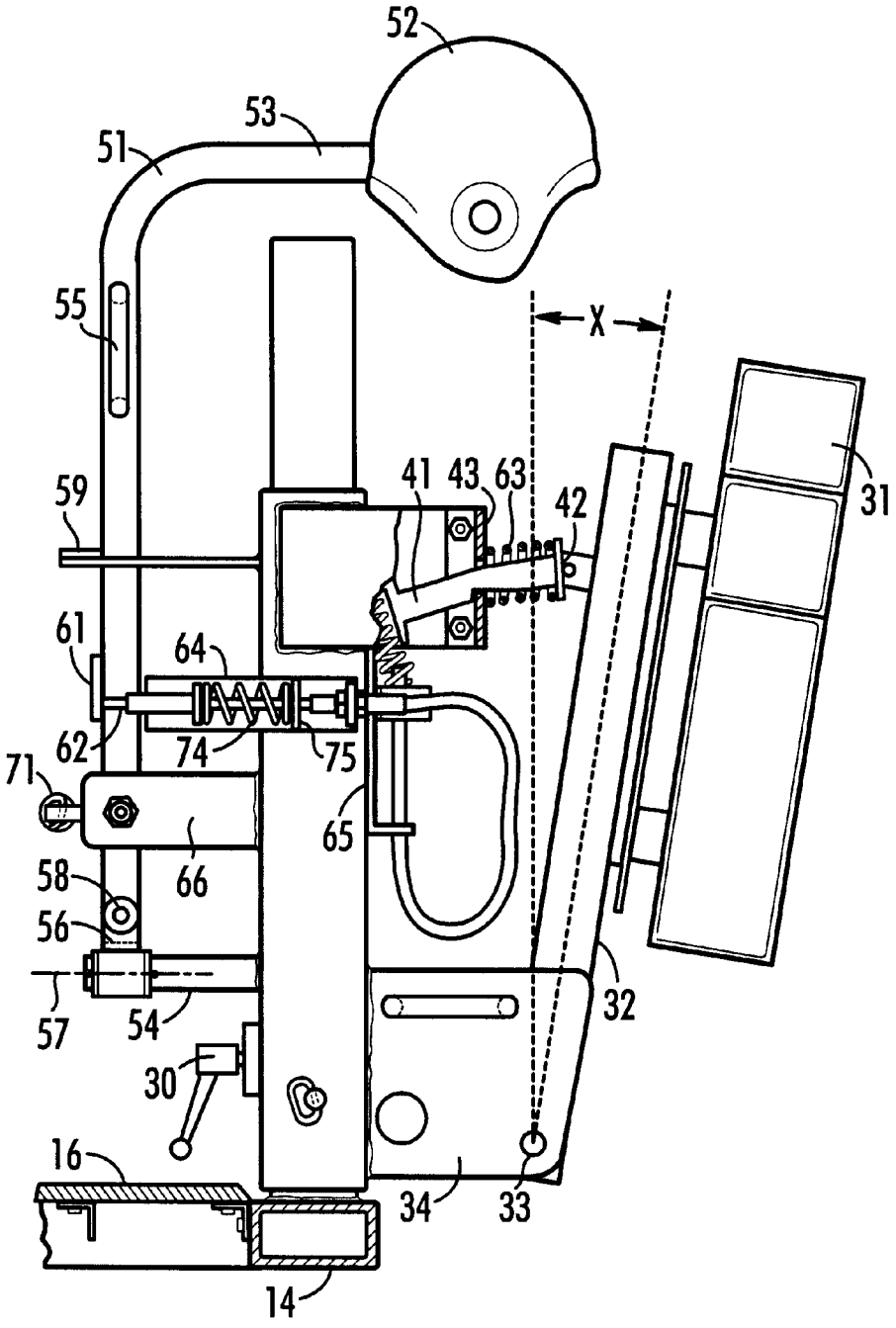
FIG. 5 is a view taken on the line 5—5 in FIG. 4 with parts broken away for illustration purposes.

As shown in FIG. 5, the latch is holding the dummy 31 in a retracted position. The rear end of the lever 41 is enlarged so that it can not pass through the opening 44 in the wall 43 when the latch is released. The lever 41 is released from its latched position illustrated in FIG. 5 by forward pivotal movement of a coach's staff 51 which has a replica of a helmet 52 secured to the forward end of a forward extending arm 53 of the staff 51. Movement of the coach's staff 51 is facilitated by hand grips 55 on laterally opposite sides of the staff 51. Referring also to FIG. 4, the lower end of the staff 51 is connected to a rearward extending bracket 54 welded to the column 26 by a universal coupling having a knuckle 56 which is pivotally connected to the bracket on a longitudinal axis 57 and pivotally connected to the staff 51 on a transverse axis 58.

Figure 6:
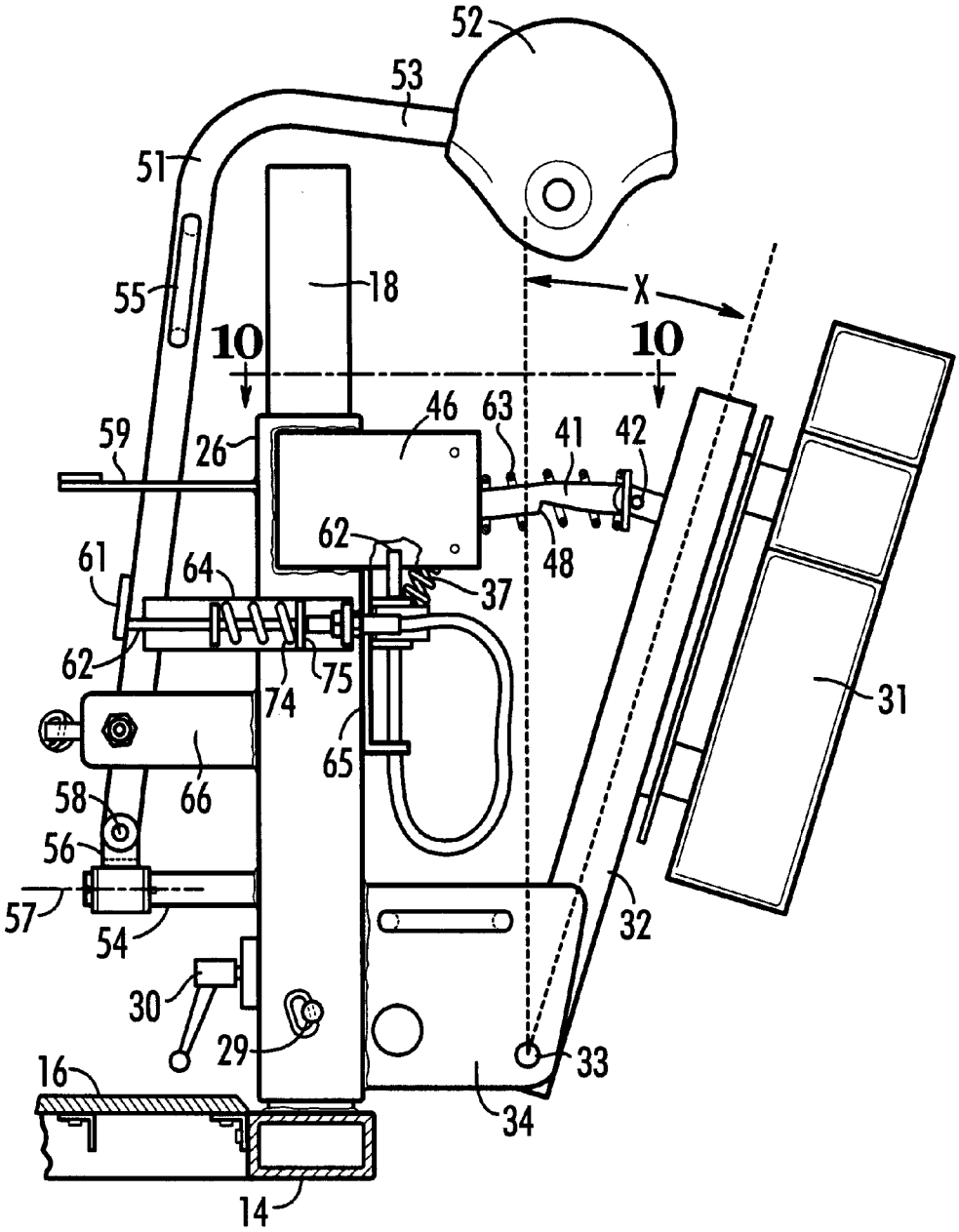
FIG. 6 shows the central dummy module in a released position.
Figure 10:
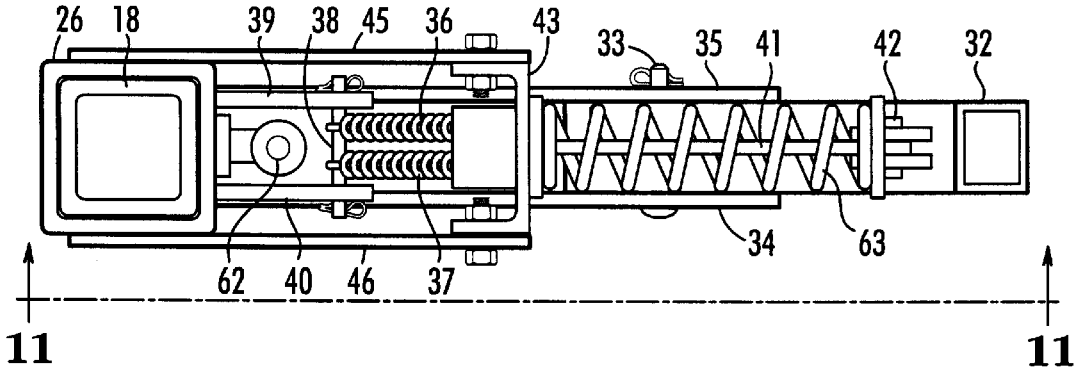
FIG. 10 is a section taken on line 10—10 in FIG. 6.
Figure 11:
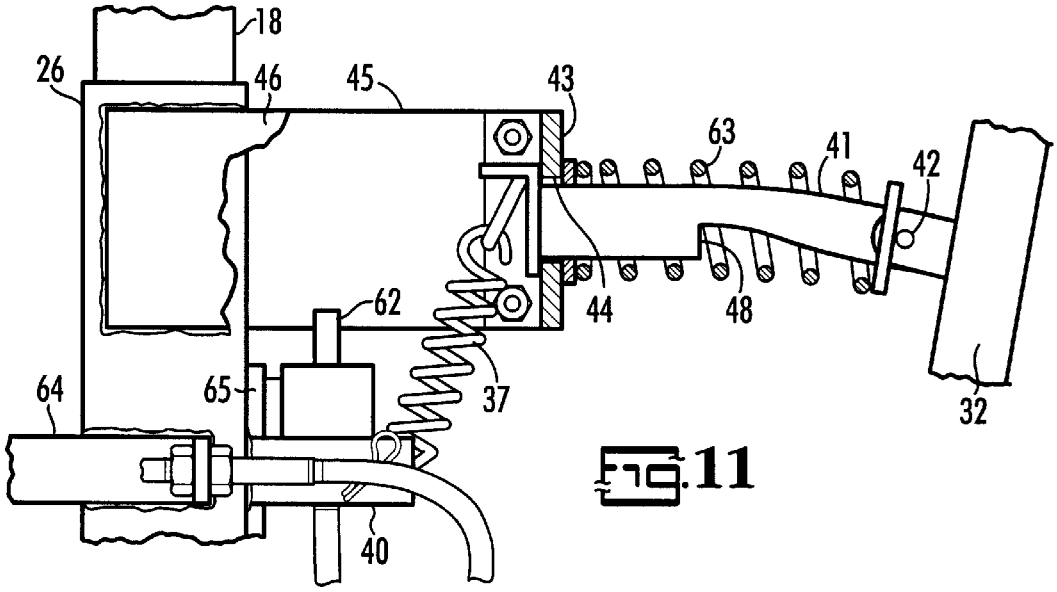
FIG. 11 is a view taken on the line 11—11 in FIG. 10 with parts broken away for illustration purposes.

As shown in FIG. 2, pivotal movement of the staff 51 is limited, by a T shaped opening in a staff guide 59 secured to the column 26, to fore and aft movement and lateral movement. When the staff 51 is pivoted forward, a thrust transmitting limb 61 on the staff 51 moves one end of a flexible thrust transmitting member or thrust rod 62 axially and the other end of the thrust transmitting member 62 pushes the rear end of the lever 41 upwardly to unlatch it from the wall 43. FIGS. 6, 10 and 11 show the latch in a released condition and the dummy module in its forwardly extended position Opposite ends of the thrust transmitting member 62 are held in position by position brackets 64, 65 welded to the column 26. Upon unlatching, the dummy 31 is pivoted forward by a resilient member, in the form of a compression coil spring 63, to the position shown in FIGS. 6, 10 and 11, in which the dummy inclination angle x is 17 degrees from a vertical position. The latch lever 41 extends through the coil spring 63, thereby serving to hold the spring 63 in a desirable position between the dummy supporting boom 32 and the column 26. A first washer is installed on the lever 41 between the compression spring 63 and the pin 42 and a second washer is installed on the lever 41 between the compression spring 63 and the wall 43. When a football player engages the dummy 31 with sufficient force, the dummy 31 and its supporting boom 32 are pivoted rearwardly and the lever notch 48 engages the lower lip of the opening in the wall 43, thereby holding the dummy 31 in its retracted position shown in FIG. 5. The dummy modules are mounted on the outer posts 21, 22 in the same manner as the dummy module is mounted on the center post 18.

As shown in FIGS. 1–6, the legs of a U-shaped support 66 welded to the column 26 support flexible thrust rods 67, 68 whose inner ends are connected to the coach's staff 51. The coach's staff 51 is biased to the neutral position, in which it is illustrated in FIGS. 1–5, by tension springs 71, 72, which have their laterally inner ends connected to a pin 73 welded to the staff 51. The laterally outer ends of the tension springs 71, 72 are connected to the legs of the U-shaped bracket 66. For illustration purposes, the springs 71, 72 are not shown in FIGS. 2 and 4. A compression spring 74, encompassing the thrust rod 62 and positioned between the thrust rod 62 and a flange 75 welded to the bracket 64, returns the staff 51 to an uprighted position when the staff 51 is released.

When the staff 51 is pivoted laterally to the right, as viewed in FIGS. 2 and 3, the outer end of the thrust rod 67 moves upward to release the latch lever 41 associated with the dummy 31 mounted on the column 27. The dummy 31 then pivots forward from its 10 degrees from vertical retained position to the released position shown in FIG. 6 in which the angle of inclination from vertical, angle x, is about 17 degrees. In a similar manner, when the coach's staff 51 is pivoted to the left, the thrust rod 68 releases the latch lever 41 associated with the dummy 31 mounted on the column 28 and that dummy springs forward to its released or extended position.

Figure 7:
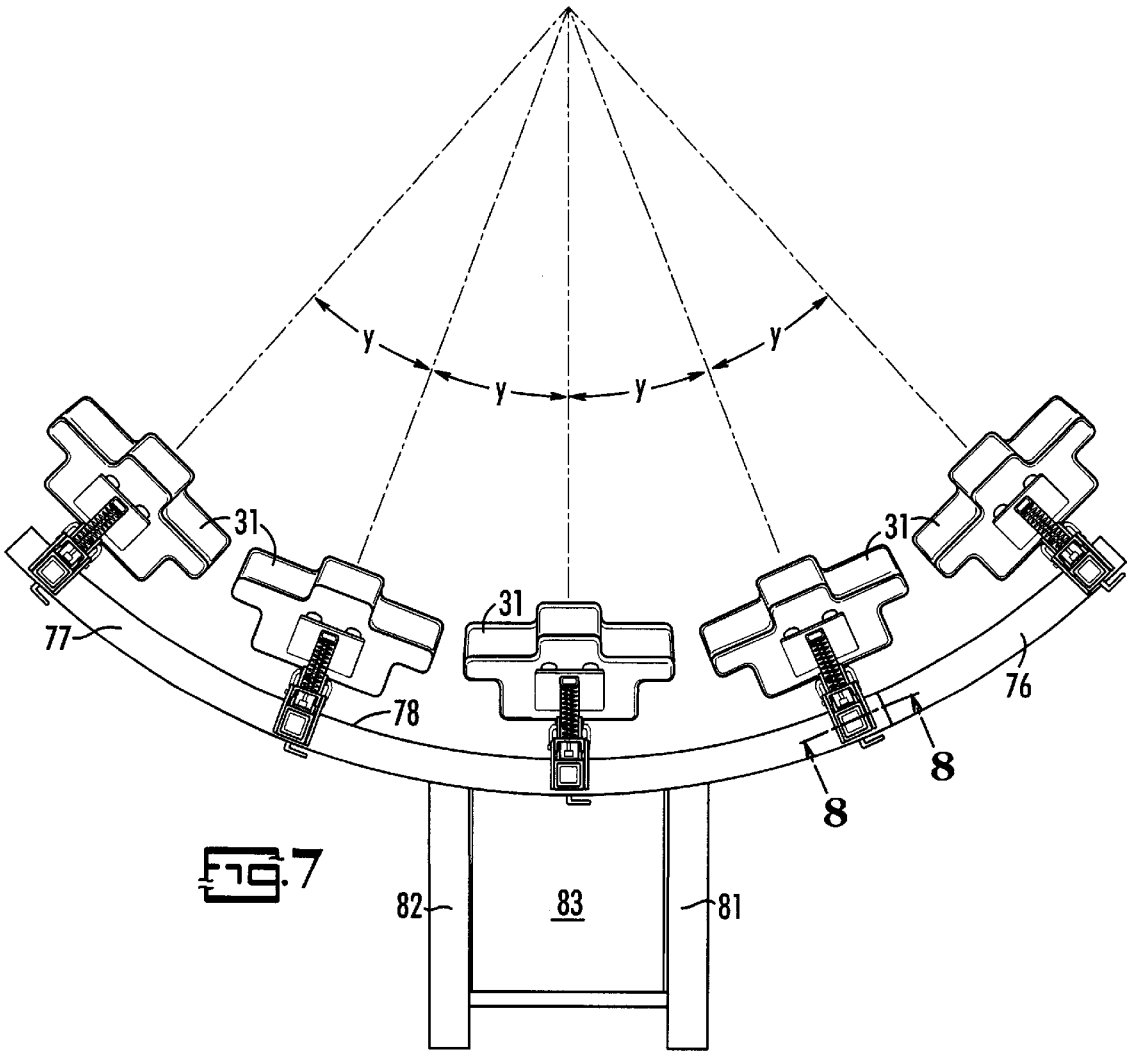
FIG. 7 is a top view of a training device with five dummy modules.

FIG. 7 illustrates a five dummy training device in which right and left wing parts or extensions 76, 77 have been added to an arcuate beam 78 of a three dummy unit. The wing parts 76, 77 have the same curvature radius as the arcuate beam 78. The five dummies 31 are positioned shoulder to shoulder with a small space between the shoulders. The arcuate spacing of the centers of the dummies is an arc angle of 22 degrees. The five dummy unit has a pair of ground engaging runners 81, 82 and a coach's platform or floor 83. Although the coach's staff and associated release mechanism are not illustrated in FIG. 7, it should be understood that this five dummy unit is equipped with such equipment. For instance the central dummy module and the laterally outermost dummy modules may be equipped with release mechanisms and the intermediate dummy modules could each be provided with a lever without a notch and with a compression spring biasing the dummy to its extended position. The arc of the arcuate beam 78 and the wing parts 76, 77 have a smaller radius than the training unit shown in FIGS. 1–6.

Figure 9:
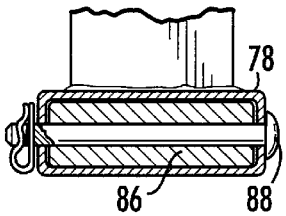
FIG. 9 is a section taken on line 9—9 in FIG. 8.
Figure 8:
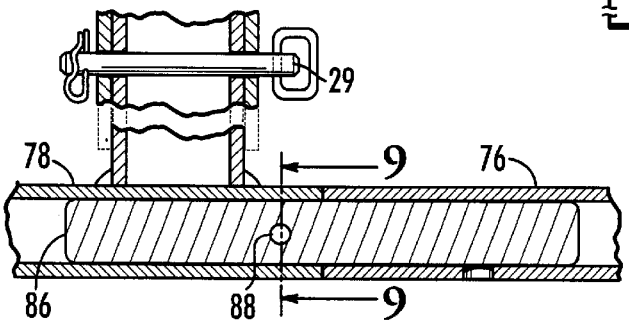
FIG. 8 is a section taken on line 8—8 in FIG. 7.

Referring to FIGS. 8 and 9, the hollow arcuate wing parts 76 includes a connector tongue 86 welded to the lower wall of the wing part 76. The tongue 86 extends into one end of the hollow arcuate beam 78 and is releasably connected thereto by a pin 88. The arcuate wing part 77 is realizably connected to the other end of the beam 78 in a similar manner.

PRACTICAL APPLICATION OF THE INVENTION

The athlete training equipment of this invention is ideal for training football linemen in offensive pass protection in that it can be used to simulate a defensive rush. In a training unit having three or more dummy modules, the laterally outer dummy modules are set ahead of the central dummy to emulate actual playing conditions. In such a unit the dummy modules are preferably pivotally connected at their lower ends to the support sled and are biased by springs 63 to a forward leaning position. When a player exerts enough force against the dummy module it will pivot rearwardly to a retracted position in which a latch lever 41 operates to hold it. A player can not fake it. The required force must be exerted to latch the dummy.

A shiftable coach's staff 51 with a helmet 52 has latch release connections with the latches holding the dummy modules in this retracted position. When the coach's staff 51 is moved directly forward the central dummy module is released to spring forward from its retracted position about 10 degrees forward of vertical, to its extended position of about 17 degrees from vertical. Lateral movement of the coach's staff 51 releases the retracted dummy module on the lateral side toward which the coach's staff is moved. The helmet movement and accompanying dummy module movement may simulate actual game conditions and the trainee may be required to react to that movement and attack the released dummy module. This practice routine helps the players develop their footwork, body position and punch control. It is an excellent training machine for improving a player's hard post, soft post, "jump them" technique, kick slide and double read. If desired, all the dummies may be released and the trainee directed to charge one of the dummies.

The action of a released dummy gives the martial arts and kick boxing trainees a moving opponent on which to improve their kicks and punches. The trainee can high kick or low kick the dummies with his foot or punch the dummies with his hand or forearm. The dummy height can be adjusted to imitate a tall or short opponent. The trainee can work from the ground, kicking up, or stay standing and explode into the dummy with his arms or legs. A hard, forceful blow is required to teach martial arts and kick boxing. This machine provides the proper training by requiring a hard forceful impact to move the dummy to its latched position. The machine can simulate multiple attackers by releasing multiple pads at random or in quick succession. Or the trainee may simply work through a predetermined sequence.

The dummy modules are vertically adjustable to emulate different heights of martial arts and kick boxing opponents and to emulate squatted and standing positions of opposing football lineman, as may be encountered in running, passing and kicking downs.

In order to punch and latch the dummy module, the athlete must utilize aggressive punch control and proper body position. The forward leaning dummy imitates the body position of an opponent and in such position requires the trainee to develop an upward punch from a low stance. The player thus improves his base and develops his power leverage in forcing the dummy module to its latched position.

The multiple dummy training machine can be used to train several athletes simultaneously. By using the coach's staff the coach can release the dummy modules one after another or only release one. The trainees can practice at half speed or full speed without beating each other up. Instructors or trainees do not need to hold a shield and get punched repeatedly. Instead, the trainees can be engaged in the practice exercises to improve their own skills. The training machine can be used indoors or outdoors, or during the off-season, with or without an instructor. The football player can improve his post, kick and redirection sets, and those improvements can be taken directly to live contact. The martial arts and kick boxing athletes can improve their kicks and punches by either working from the ground kicking up or by staying on their feet and exploding into the dummy pad with their arms and legs.

The herein illustrated and described multiple dummy training machines each employ a sled on which at least three substantially upright dummy modules are connected to a dummy support structure in the form of the beam 14 by spring biased connections which resiliently bias the dummy module toward a forwardly inclined or leaning position simulating an opposing athlete. The dummy modules preferably face the center of the circle defined by the position of the dummy modules on the sled.

What is claimed is:

1. An athlete training device, comprising:

a ground engaging base having a front end and a rear end;

an upright post rigidly mounted at its bottom end on said base near said front end of said base, said bottom end of said post being close to ground level, a hollow column part encompassing and telescopically fitted on said post, said column part having an upper end and a lower end and said column part being vertically adjustable relative to said post between a lowered position in which said lower end is near said bottom end of said post and the top end of said post extends a substantial distance above said column part and a raised position in which said lower end of said column part is a substantial distance above said bottom end of said post and aid post is in confronting relation to the full length of the interior surface of said column;

a dummy support part having a lower end pivotally connected to said lower end of said column part on a horizontal axis transverse to the front to rear orientation of said ground engaging base, said horizontal axis being near ground level when said column part is in its lowered position;

a dummy on said dummy support part;

a motion limiting mechanism between said dummy support part and said column part limiting pivotal movement of said dummy support part about said horizontal axis to movement between a predetermined forwardly inclined position and a predetermined retracted position;

a resilient member interposed between said column part and said dummy support part, said resilient member biasing said dummy support part toward said extended position and a releasable latch associated with said dummy support part and said column part operable to hold said dummy support part in said retracted position when said dummy support part is moved from said extended position to said retracted position and a manually operable latch disengaging mechanism operatively associated with said latch.

2. An athlete training devise as set forth in claim 1 having an upright coach's staff pivotally connected at its lower end to said column part, said latch disengaging mechanism being operated by pivotal movement of said staff.

3. An athlete training devise as set forth in claim 2 having a replica of a helmet on the upper end of said staff.

4. An athlete training device as set forth in claim 1 wherein said releasable latch includes a lever pivotally connected at one of its ends to an upper portion of one of said parts, wherein said motion limiting mechanism includes confronting abutments on said lever and the other of said part and wherein said resilient member is a coil compression spring through which said lever extends.

5. An athlete training device set forth in claim 4 wherein said column part includes a vertical wall with an opening through which said lever extends, said abutment on said other part being on said vertical wall below said opening, and wherein said lever includes a notch on its underside presenting said abutment formed on said lever.

6. An athlete training device set forth in claim 5 having a spring between said lever and one of said column part and said dummy support part biasing said lever toward the bottom of said opening.

7. An athlete training device as set forth in claim 4 having an upright coach's staff pivotally connected at its lower end to said column part and wherein said latch disengaging mechanism includes a flexible thrust rod extending between said staff and said lever.

8. An athlete training device as set forth in claim 1 having a floor on said base for supporting a coach.

9. An athlete training device comprising:

a sled having front and rear ends;

a floor on said sled;

a beam on said front end of said sled including a central part and a pair of end parts extending outward in laterally opposite directions, respectively, and forwardly of said central part, an upright post mounted on said central part of said beam;

an upright post mounted on each of said end parts of said beam;

a hollow column part telescopically mounted on each of said posts;

a dummy support boom part having a lower end pivotally connected to the lower end of each of said column parts for vertical swinging movement between extended and retracted positions toward and away from, respectively, a center of an arc defined by the position of said posts a mechanism limiting swinging of each of said boom parts toward said center;

a dummy mounted on each of said boom parts, said dummy facing toward said center and a resilient member between each of said boom parts and the associated column part biasing said boom part toward said center.

10. An athlete training device as set forth in claim 9 wherein said hollow column part is vertically adjustable on the associated post.

11. An athlete training device as set forth in claim 10 said hollow column part is vertically adjustable between adjusted positions emulating a down lineman position and a standing lineman position.

12. An athlete training devise as set forth in claim 11 including a releasable fastener on said hollow column part selectively operable to secure said hollow column to said post at the selected adjusted position.

13. An athlete training device as set forth in claim 9 having a releasable latch between each of said boom parts and the associated column part operable to hold said boom part in said retracted position when said boom part is moved to said retracted position.

14. An athlete training device as set forth in claim 13 having a manually operated control operatively associated with said latches permitting a person positioned on said floor to selectively release said latches.

15. An athlete training device as set forth in claim 9 wherein said beam is arcuate.

16. An athlete training device as set forth in claim 9 having a laterally outward and forward extending wing part detachably secured to each of said end parts of said beam and having a dummy mounted on each of said wing parts.

17. An athlete training device as set forth in claim 16 wherein said beam and said wing parts are acuate.

18. An athlete training device as set forth in claim 9 wherein said dummy is disposed between 0 ad 10 degrees from vertical in said retracted position and is disposed between 15 and 30 degrees from vertical in said extended position.

19. An athlete training device as set forth in claim 13 having a coach's staff pivotally connected at its lower end to said column part on said post on said central part of said beam and a latch releasing mechanism operatively interposed between said staff and said latches, forward swinging movement of said staff releasing said latch associated with said dummy support boom part mounted on said column part on said post on said central part, lateral pivotal movement of said staff releasing said latch associated with said dummy support boom part mounted on the said post on said end part at the lateral side toward which said staff is pivoted.

20. An athlete training device set forth in claim 19 having a staff guide on said column part on said post secured to said central part of said beam, said staff guide limiting movement of said staff to fore an aft movement and lateral movement.

21. An athlete training devise as set forth in claim 9 wherein said mechanism limiting swinging includes a lever extending between said boom part and said column part and wherein said resilient member is a coil compression spring through which said lever extends.

22. An athlete training device comprising:

a sled having front and rear ends;

a floor for supporting a coach, a beam on said front end of said sled including a central part and ends parts, said end parts extending in laterally opposite directions and forwardly from said central part;

an upright post having a bottom end mounted on said central part of said beam;

a pair of upright posts having bottom ends mounted, respectively, on said ends parts of said beam;

a hollow column part telescopically mounted on each of said posts, a dummy support boom part having a lower end pivotally connected to each of said column parts on a horizontal axis for swinging movement between extended and retracted positions toward and away from, respectively, and axis of an arc defined by the position of said posts on said beam;

a dummy secured to each of said boom parts, each of said dummies facing forward said axis, a latch between said boom and column parts operable to releasably maintain said boom part in said retracted position, said latch including a lever pivotally connected to one of said boom and column parts for pivotal movement between a latch position and a release position, and engageable abutment surfaces on said lever and the other of said boom and column parts, said lever pivoting to said latch position to place said abutment surface in engagement, thereby holding said boom part in said retracted position, when said boom part is pivoted to said retracted position;

a manually operable release mechanism operable to release said lever from said latch position and a compression spring between said boom and column parts biasing said boom part toward said extended position.

23. An athlete practice device as set forth in claim 22 wherein said compression spring is a coil spring through which said lever extends.

24. An athlete practice device as set forth in claim 22 wherein said manually operable release mechanism includes a coach's staff with a lower end pivotally connected to said column part on said post mounted on said central part of said beam and a motion transmitting component between each of said levers and said staff whereby forward pivotal movement of said staff releases the latch associated with said column part on said post mounted on said central part of said beam and whereby lateral pivotal movement of said staff releases the latch associated with the dummy located on said end part of said beam at the lateral side of said device toward which said staff is pivoted.

25. An athlete training device comprising:

a sled having front and rear ends, a beam rigidly secured to said front end of said sled including a central part and a pair of end parts extending laterally outward in opposite directions, respectively, from said central part and extending forwardly of said central part, and an upright dummy module support on each of said central and end parts of said beam, an upright dummy module having a lower end pivotally mounted on said dummy module support for swinging movement about a horizontal axis between a retracted position and a forwardly extended position, and resilient means between said dummy module support and said dummy module biasing said dummy module toward said extended position.

26. An athlete training device as set forth in claim 25 wherein said dummy modules face toward the center of an arc of a circle defined by the position of said dummy module supports.

27. An athlete training device as set forth in claim 25 wherein the horizontal shape of said beam is an arc.

28. An athlete training device as set forth in claim 27 wherein said dummy modules face toward the center of said arc.

29. An athlete training device comprising:

a sled having front and rear ends, a dummy support structure at said front end of said sled including a central part and a pair of end parts extending laterally outward in opposite directions, respectively, from said central part and extending forwardly of said central part, whereby the horizontal shape of said central and end parts is an arc, an upright dummy for each of said central and end parts, and a connection between each of said central and end parts and its associated dummy resiliently biasing said dummy toward a forwardly inclined position and permitting rearward swinging movement about said connection when said dummy is impacted in a rearward direction by an athlete.

30. An athlete training device as set forth in claim 29 having an upright coach's staff moveably mounted on said sled and having a dummy helmet thereon, said coach's staff being manually moveable laterally to designate which of said dummies a training athlete is expected to impact.

* * * * *